US009033604B2

(12) United States Patent
Gueret

(10) Patent No.: US 9,033,604 B2
(45) Date of Patent: May 19, 2015

(54) APPLICATOR FOR APPLYING A COMPOSITION TO THE EYELASHES OR THE EYEBROWS

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 1765 days.

(21) Appl. No.: 11/976,900

(22) Filed: Oct. 29, 2007

(65) Prior Publication Data

US 2008/0107470 A1 May 8, 2008

Related U.S. Application Data

(60) Provisional application No. 60/866,717, filed on Nov. 21, 2006.

(30) Foreign Application Priority Data

Nov. 2, 2006 (FR) ..... 06 54697

(51) Int. Cl.

| | |
|---|---|
| ***A46B 11/00*** | (2006.01) |
| ***A46B 9/02*** | (2006.01) |
| ***A45D 40/26*** | (2006.01) |
| ***A46B 3/16*** | (2006.01) |

(52) U.S. Cl.

CPC ..... *A46B 9/021* (2013.01); *A45D 40/265* (2013.01); *A45D 2200/207* (2013.01); *A46B 3/16* (2013.01); *A46B 2200/1053* (2013.01); *A46B 2200/106* (2013.01)

(58) Field of Classification Search

USPC ..... 401/121, 122, 126–130

See application file for complete search history.

(56) References Cited

U.S. PATENT DOCUMENTS

| | | | | |
|---|---|---|---|---|
| 6,227,737 | B1 * | 5/2001 | Lightfoot | 401/129 |
| 6,295,994 | B1 * | 10/2001 | Thayer et al. | 401/129 |

FOREIGN PATENT DOCUMENTS

| | | |
|---|---|---|
| JP | A-58-40008 | 3/1983 |
| JP | A-2001-017234 | 1/2001 |
| JP | A-2004-000587 | 1/2004 |
| JP | A-2005-052649 | 3/2005 |
| WO | WO 2006/020577 A2 | 2/2006 |

OTHER PUBLICATIONS

Sep. 25, 2012 Office Action issued in JP Application No. 2007-285390 (with partial English translation).

* cited by examiner

*Primary Examiner* — Tuan N Nguyen
(74) *Attorney, Agent, or Firm* — Oliff PLC

(57) ABSTRACT

The present invention relates to an applicator for applying a composition to keratinous fibers, in particular the eyelashes or the eyebrows, the applicator including a stem having a longitudinal axis and including at least one elastically-deformable flexible portion that is suitable for flexing during application and/or wiping; and an applicator element that is fastened to the stem and that includes a twisted wire core and bristles that extend transversally to the longitudinal axis of the stem.

19 Claims, 9 Drawing Sheets

APPLICATOR FOR APPLYING A COMPOSITION TO THE EYELASHES OR THE EYEBROWS

This non provisional application claims the benefit of French Application No. 06 54697 filed on Nov. 2, 2006 and U.S. Provisional Application No. 60/866,717 filed on Nov. 21, 2006.

The present invention relates to applicators for applying makeup or a care product to keratinous fibers, and more particularly, but not exclusively, to the eyelashes or the eyebrows.

The invention relates to an applicator comprising a stem and an applicator element that is disposed at one end of the stem.

BACKGROUND

Mascara applicators are known including a stem that is relatively rigid.

U.S. Pat. No. 6,305,861 discloses applicators including relatively thin stems of small section over a large fraction of their length, and thus being very flexible. Under certain application conditions, the flexibility of the stem can reduce precision in applying makeup. In addition, such stems cannot be wiped in satisfactory manner when they are used with certain types of wiper members, e.g. annular-lip wiper members.

Patent application FR-A-2 759 872 discloses an applicator including a flat handle that includes a narrowing.

In addition, application FR 2 705 876 discloses an applicator having a stem that is provided with a narrowing that comes to be positioned facing a wiper member. The narrowing does not impart any flexibility during application.

US 2006/0042467 A1 discloses a mascara applicator comprising a stem having a flexible portion and carrying an application member. The latter comprises a housing configured for receiving a support portion connected to the stem. The application member is rotatable, in an embodiment. The presence of the housing necessitates to make the application member in a specific manner.

SUMMARY

There exists a need to improve still further applicators for applying makeup to keratinous fibers, in particular the eyelashes or the eyebrows, and to have a novel applicator that is comfortable and easy to use.

The present invention seeks, in particular, to satisfy that need.

The invention provides an applicator for applying a composition to keratinous fibers, in particular the eyelashes or the eyebrows, the applicator comprising:

- a stem having a longitudinal axis and including at least one elastically-deformable flexible portion that is suitable for flexing during application and/or wiping; and
- an applicator element that is fastened to the stem and that includes bristles or teeth that extend transversally to the longitudinal axis of the stem.

The invention makes it possible to apply makeup accurately.

The presence of the flexible portion imparts lightness in application, even with a relatively rigid applicator element such as a comb, for example, or with a brush having relatively stiff bristles.

Since the stem is connected to a handle, the flexible portion may also serve, while the applicator element is being removed from the receptacle, to enable the applicator element to form an angle with the handle, thereby enabling the applicator element to remain more easily in alignment with the longitudinal axis of the receptacle containing the composition. When said receptacle is provided with a wiper member, the applicator element may be wiped more effectively, with the composition being distributed in more uniform manner on the applicator element.

The flexible portion also enables the user to incline the handle relative to the receptacle using a natural movement of the hand, while the applicator element is being removed.

The resistance of the composition on the eyelashes or the eyebrows can slow down and deform the applicator element, which, in deforming, accumulates elastic energy. The restoration of elastic energy thus accumulated when the applicator element relaxes on arriving at the tips of the eyelashes or the eyebrow hairs may result in an acceleration and an additional movement that is likely to improve the extension and the separation of the eyelashes or the eyebrow hairs.

The flexible portion may also reduce the risk of poking the eye hard with the applicator element.

The term "elastically deformable" should be understood as the flexible portion presenting a certain amount of shape memory. The expression "elastically deformable" should be understood in a broad sense, and, in particular, covers the flexible portion, after having been deformed, returning by elasticity to a position that is not exactly identical to its initial position, given the nature of the material used to make the flexible portion and the shape of said flexible portion, for example.

The term "rigid portion" should be understood as being a portion that does not deform substantially during application. A rigid portion may be subjected to a small amount of deformation overall when stress is exerted thereon by the fingers, for example.

By way of example, the flexible portion is capable of flexing so as to modify the orientation of the entire applicator element over more than 30°, for example.

The flexibility of the flexible portion may result from its shape and/or from the material(s) used to make it.

Stem

The term "stem" refers to the assembly formed by the flexible portion(s) and by the rigid portion(s) of the stem.

The stem extends axially between the handle and the applicator element. The length of the stem is measured between its end adjacent to the applicator element and its end for connecting to the handle, e.g. the end where the stem is connected to a transverse plate, inside the handle.

The flexible portion may extend along a longitudinal axis that is optionally rectilinear, the axis extending in alignment with the axis of the applicator element.

The flexible portion may be made by molding, e.g. by injection molding a thermoplastic material. In particular, the flexible portion need not be stamped.

The flexible portion may be made by being overmolded onto a rigid portion of the stem. In a variant, the flexible portion may be fastened to the remainder of the stem by snap-fastening, by adhesive, by screw-fastening, by force-fitting, or by crimping. The stem may include a rigid portion having at least one housing for receiving at least one fastener portion for fastening the flexible portion on the rigid portion. In a variant, the flexible portion may include at least one housing for receiving at least one fastener portion for fastening the rigid portion of the stem on the flexible portion. The fastener portion of the flexible portion may present an enlarged head or a narrowing in order to improve the hold by the rigid portion of the stem in the event of crimping.

The flexible portion of the stem may be hot or cold mounted on the remainder of the stem and/or on the applicator element, in particular by means of its deformability, or it may be overmolded onto the remainder of the stem and/or onto the applicator element.

The flexibility of the flexible portion may be selected as a function of the properties desired for application, e.g. by selecting material(s) that make up the flexible portion, in particular their Shore hardness. The hardnesses of the materials of the flexible portion of the stem and the adjacent rigid portion of the stem may be different.

The flexible portion may be made, at least in part, of a material from the following list: elastomer, thermoplastic, or thermoplastic elastomer material; low-density polyethylene (LDPE); polyvinyl chloride (PVC); polyurethane (PU); thermoplastic elastomer polyesters, in particular copolymers of butene terephthalate and esterified polytetramethylene oxide glycol; Hytrel®; ethylene-propylene terpolymer rubber (EPDM); phenylene dimaleimide (PDM); ethylene vinyl acetate copolymer (EVA); styrene-isoprene-styrene (SIS); styrene-ethylene-butylene-styrene (SEBS); styrene-butadiene-styrene (SBS); latex; silicone; nitrile rubber; butyl; polyurethane; polyether block amide; and polyester; this list not being limiting.

The flexible portion may be made of a material having hardness that lies in the range 25 on the Shore A scale to 80 on the Shore D scale, for example, or even that lies in the range 40 on the Shore A scale to 70 on the Shore D Scale.

The total visible length l of the flexible portion lies in the range 10 millimeters (mm) to 35 mm, for example.

A greatest transverse outside dimension of the flexible portion lies in the range 2 mm to 10 mm, for example.

The flexible portion may be magnetizable, e.g. including a filler of magnetic particles or of magnetic fibers.

The flexibility of the flexible portion may vary as a function of the cross-section and of the profile of the flexible portion.

The flexible portion may have a cross-section that is solid or hollow and of shape that varies, e.g. of shape selected from the following list: polygonal; square; rectangular; triangular; circular; non-circular; oblong; oval; elliptical; notched; star-shaped; or with one or more annular or axial grooves.

The flexible portion may be circularly symmetrical about the longitudinal axis of the stem.

The flexible portion may present a narrowing, where appropriate. The narrowing may be of annular shape. Thus, in some embodiments, the flexible portion of the stem is hourglass shaped, or it presents an annular groove that is crenellated.

Also, the flexible portion of the stem need not be circularly symmetrical. Such a shape makes it possible to obtain stem flexibility that varies along the direction of inclination of the applicator element relative to its initial configuration. In particular, the flexible portion of the stem may present a cross-section that is generally elongate in shape. The handle may include at least one reception zone for receiving a finger, in particular a flat or an indent that may generally extend substantially parallel to a long axis of a cross-section of the flexible portion. The shape of the handle need not be circularly symmetrical, thereby favoring a predefined orientation for holding the applicator.

The flexible portion may be symmetrical about a mid-plane.

The flexible portion may have a greatest transverse dimension, e.g. an outside diameter of the flexible portion, that is equal to a greatest transverse dimension of the stem, e.g. an outside diameter of the stem. In a variant, the flexible portion may have a greatest transverse dimension that is greater than a greatest transverse dimension of the stem. Still in a variant, the flexible portion may have a greatest transverse dimension that is less than a greatest transverse dimension of the stem.

The flexible portion may be flocked, at least partially, which may allow the flexible portion to be loaded with product and to be used to apply the product on the eyelashes or the eyebrows, for example. The flocked portion may be magnetic or magnetisable, which may allow the flocked portion for example to exert an action on the product before and/or after application, for example to lengthen the lashes when the product comprises magnetic pigments or filler.

The visible portion of the flexible portion may be thinner than its portion for fastening in the portion of the stem.

The stem may include a single flexible portion, the remainder of the stem being rigid, i.e. not deforming substantially during application.

The stem may be circularly cylindrical or substantially circularly cylindrical, at least over a major fraction of its length. By way of example, the stem may be other than flat along a plane. By way of example, the length of the stem may be much greater than its width, e.g. more than twice, or even more than three times, better more than five times greater than its width.

The stem may be connected rigidly to the handle. In a variant, a hinge may be present between the stem and the handle.

The flexible portion may be disposed at a first end of the rigid portion of the stem, and it may be adjacent to the applicator element.

The flexible portion may include a housing for fastening the applicator element, in particular for receiving a portion of the applicator element, e.g. the core of the applicator element.

In a variant, the flexible portion may be disposed between a rigid distal portion of the stem, and a rigid proximal portion of the stem.

The stem may include a rigid distal portion that extends between the applicator element and the flexible portion, and a rigid proximal portion that extends between the flexible portion and a second end of the stem that is connected to the handle. The rigid proximal and distal portions of the stem are thus interconnected via the flexible portion. The rigid distal and proximal portions may present the same diameter.

The length of the rigid proximal portion of the stem may be greater than the length of the rigid distal portion of the stem. The length of the proximal portion may be greater than the length of the distal portion by a factor of 1.5, better 1.7, or even at least 2.

The length of the flexible portion may be less than the length of at least one of the rigid distal and proximal portions. In particular, the flexible portion may extend over less than one third of the total length of the stem, better over less than one fourth.

The stem may include a rigid top half, the flexible portion being situated in the bottom half of the stem, thereby being close to the applicator element.

The flexible portion of the stem may deform during application so as to enable the applicator element or the rigid distal portion of the stem to become substantially inclined relative to the rigid proximal portion of the stem.

The rigid distal and proximal portions may each be substantially rectilinear during application.

Regardless of how the stem is made, the flexible portion may be configured in such a manner that the entire applicator element can be inclined in reversible manner during application, e.g. by more than 10°, better 15°, still better 30°, or even by more than 45° or 60°, compared to an initial rest configuration in which the applicator element and the stem are substantially in alignment, for example.

In some embodiments, the core of the applicator element need not deform in visible manner when the flexible portion deforms in order to modify the orientation of the applicator element relative to the stem.

The rigid portion(s) of the stem may have a cross-section that is solid or hollow, and of shape selected from the following list: circular; non-circular; oblong; oval; elliptical; polygonal; square; rectangular; triangular; kidney-shaped; notched; star-shaped; or with one or more grooves. A circular cross-section may be preferred.

The proximal and distal portions may be made of the same material, or else of two respective different materials, at least in part.

The rigid portion(s) of the stem may be made of a thermoplastic material, in particular one of the materials selected from the following list: high-density polyethylene (HDPE); low-density polyethylene (LDPE); linear polyethylene (LPE); PT; polypropylene (PP); polyoxymethylene (POM); polyamide (PA); polyethylene terephthalate (PET); and polybutylene terephthalate (PBT); this list not being limiting.

The end of the stem to which the applicator element is fastened may include a housing for fastening the applicator element. The housing may be formed in the flexible portion or in a rigid distal portion of the stem. A rigid portion of the stem may also include a housing for fastening the flexible portion thereon. Both housings may be of identical shape and size, at least before fastening the applicator element or the flexible portion, thereby making it easy to eliminate the flexible portion in order to fasten the applicator element directly to the rigid portion of the stem.

When the housing for fastening the applicator element is formed in the flexible portion in particular, the housing may be configured to make it possible to fasten applicator elements having fastener portions of different sizes. The size and the shape of the housing may be variable, e.g. because of the deformability of the material of the flexible portion.

The flexible portion may comprise an endpiece which is fixed in a housing of the rigid portion of the stem by crimping, i.e. by deforming the wall defining the housing.

The end of the stem to which the applicator element is connected may be beveled so as to make it easier for the applicator to be inserted into the receptacle and to pass through the wiper member. In an embodiment, it is the flexible portion that is beveled. The stem may include a rigid portion that is not beveled at its end adjacent to the flexible portion.

The rigid portion of the stem and the flexible portion preferably have transverse dimensions that are close so as to favor wiping, e.g. they have the same diameter.

At its second end, the stem may include a fastener portion for fastening on the handle, e.g. an endpiece for force-fitting and/or snap-fastening in the handle. The endpiece may include a tubular skirt with a plate at its base. The stem may also be molded with the handle.

The handle may be arranged in such a manner as to close, in leaktight manner, a receptacle containing the composition for application.

The handle may include fastener means for fastening on the receptacle, e.g. a thread or at least one annular snap-fastener bead.

Applicator Element

The applicator element may extend along a longitudinal axis that need not be perpendicular to a longitudinal axis of the stem. By way of example, both axes may substantially coincide or may form between them an angle that is strictly less than 90°.

The applicator element may include a fastener portion for fastening to the stem, said fastener portion having a length that is preferably less than the length of the flexible portion, the lengths being measured along the longitudinal axis of the stem.

The applicator element may include a core that is more rigid than the flexible portion of the stem.

In an exemplary embodiment which is advantageous the applicator member comprises a twisted wire core. By "twisted wire core" one understands a core comprising at least two lengths of a metallic wire that are twisted. The core may be with a simple twisting, comprising only two wires twisted together, or be with double twisting, comprising two twisted wires arrangements twisted together to hold bristles, each twisted wire arrangement possibly holding bristles or not.

An advantage lying with the use of such a twisted wire core is that most mascara brushes existing on the market are made with such a twisted wire core.

The core may be non rotatable with respect to the stem around the longitudinal axis of the stem.

When the core comprises two lengths of metallic wire twisted together, the wires may be twisted with a left pitch or a right pitch.

The wire forming the wire length may have a diameter ranking from 0.35 to 1 mm, for example.

In this event, the fastener portion may be a portion of the core that does not have bristles, said portion being for inserting into a corresponding housing of the stem, e.g. a housing of the flexible portion or of a rigid portion of the stem.

The use of a twisted wire core may allow, eventually, a better holding of the core in the flexible portion, thanks to a cold or hot force fitting.

The envelope surface of the applicator element may present a cross-section that is not circular at least one point along its length. At least one point along its length, the cross-section of the envelope surface of the applicator element may present a general shape selected from the following list: non circular, polygonal, in particular triangular, square, rectangular, pentagonal, or hexagonal; oblong, in particular oval or lens-shaped; or some other shape.

For at least one cross-section of the envelope surface, the core may define a center of symmetry of said section. The core may also be off-center within the cross-section of the envelope surface at least one point along the length of the applicator element.

The envelope surface may be of non-constant cross-section over the major portion of the length of the applicator element.

The applicator element may present at least one concave face. The applicator element may present at least one convex face, of radius of curvature, when the applicator element is observed in cross-section, that is greater than the length of the longest bristle extending from the core in said cross-section.

The core of the applicator element may include a substantially rectilinear portion that possibly forms an angle with the longitudinal axis of the stem that is less than 20°.

The core may present a free end, remote from the stem, that may constitute the point of the core that is the furthest away from the longitudinal axis of the stem. The free end of the core may be situated at a distance from the longitudinal axis of the stem of less than 7.5 mm.

According to other aspects of the present invention the applicator member does not comprise a twisted wire core.

The core may for example include at least one through hole in which a bundle of bristles is held. The bundle of bristles may have a first end and may divide on going away from the first end into at least two sub-bundles of bristles that extend, at least in part, outside the core. The bristles of a bundle may be separated into two sub-bundles so as to form a V, for example, or they may be separated into more sub-bundles so as to form an X, for example. Such an applicator element is described in EP 1 454 561.

The applicator element may also be made by molding a plastics material, in particular by injection molding, and it may form an injection-molded comb or brush. The applicator element may include a core and bristles or teeth extending from the core.

The material of the applicator element may be selected so as to match the flexibility of said applicator element to the desired use. By way of example, it may be selected in such a manner that the applicator element is sufficiently flexible.

The fastener portion may be an end portion, e.g. a cylindrical portion, that does not have teeth or bristles, for inserting into a corresponding housing of the stem, for example.

In a variant, the flexible portion is made integrally with all or part of the applicator element, before said applicator element is fastened to the remainder of the stem. However, in this event and in the meaning of the present invention, the flexible portion is considered as forming part of the stem.

Bristles

The applicator may include bristles having a greatest transverse dimension lying in the range 65 micrometers (μm) to 400 μm, for example.

The bristles may be solid or hollow, of optionally circular section.

The bristles may optionally come into contact with the flexible portion.

The applicator may include at least one bristle made of an elastically-deformable material, such as an elastomer, for example.

The applicator may include at least one bristle including a compound, e.g. a particulate or other compound, making it possible to improve sliding of the bristle over keratinous fibers, or, in contrast, making it possible to create surface roughness to catch the fibers more strongly.

The applicator may include a mixture of bristles.

The applicator may include bristles having different diameters.

The applicator may include at least one bristle presenting at least one undulation, and, in particular, it may include at least two bristles, each including at least one periodic pattern presenting at least one undulation, at least two periodic patterns being different. The two different periodic patterns may belong to two distinct bristles or to the same bristle, and the undulations may present different shapes, e.g. a sawtooth shape or a sinusoidal shape, or even different amplitudes, or even undulations of different spatial frequencies. The expression "periodic pattern" means, within a bristle, a portion of said bristle that is substantially reproduced, in periodic manner, along the bristle.

The applicator may include bristles that are made other than by being injection-molded with the core, and the applicator element may include at least one portion having curved bristles extending in oriented manner from the core, e.g. as described in US application No. 2004/0168698. The term "extending in oriented manner" means that the curved bristles extend with a general orientation that is defined during manufacture of the applicator element, and they do not extend with completely random orientations. In particular, the bristles may be oriented in the same circumferential direction around the core. The bristles of the applicator element may be curved by contact with a hot surface, in particular a surface moving relative to the applicator element.

By way of example, the applicator element may include at least two deformed bristles that are engaged between two adjacent turns, each bristle presenting a removal of material or a flattening at least one point along its length from the core, and extending outwards, non-radially, from said point, as described in US application No. 2004/0240926. Each deformed bristle may include two rectilinear portions forming a bend between them. The two rectilinear portions may present the same cross-section. All of the deformed bristles may define bends that are all situated substantially at the same distance from the core.

By way of example, the applicator element may include 5 to 80 bristles per turn, even 15 to 40, in particular 10 to 50 bristles per turn. The applicator element may also include only 5 to 20 bristles per turn. The number of bristles per turn corresponds to the number of bristle ends counted by a stationary observer while the applicator element turns through 180° about its core.

The applicator may include twisted bristles, e.g. as described in U.S. Pat. No. 6,390,708.

The applicator element may be caused to vibrate either by a generator that is mounted in the applicator, in particular on the handle, in optionally removable manner, or by an external vibrating element that is mounted on a finger of the user, for example.

Packaging and Applicator Devices

The invention also provides a packaging and applicator device for applying a cosmetic composition, the device comprising an applicator as defined above, and a receptacle containing the composition for application.

The device may further include a wiper member that is disposed in such a manner as to wipe the applicator element while it is being removed from the receptacle. The wiper member may be fastened in the neck of the receptacle.

The wiper member may include a lip made of elastomer or of polyethylene, or, in a variant, it may comprise a block of foam, e.g. slotted in its middle. Also, the wiper member need not include any porous material.

The wiper member may be adjustable, in particular so as to make it possible to adjust the size of the wiper orifice.

The composition is makeup or a care product for the eyelashes or the eyebrows. The composition may be mascara, for example.

The composition may be a liquid, or a paste.

The handle may close the receptacle in leaktight manner, and it may be screw-fastened on the neck of the receptacle, for example.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
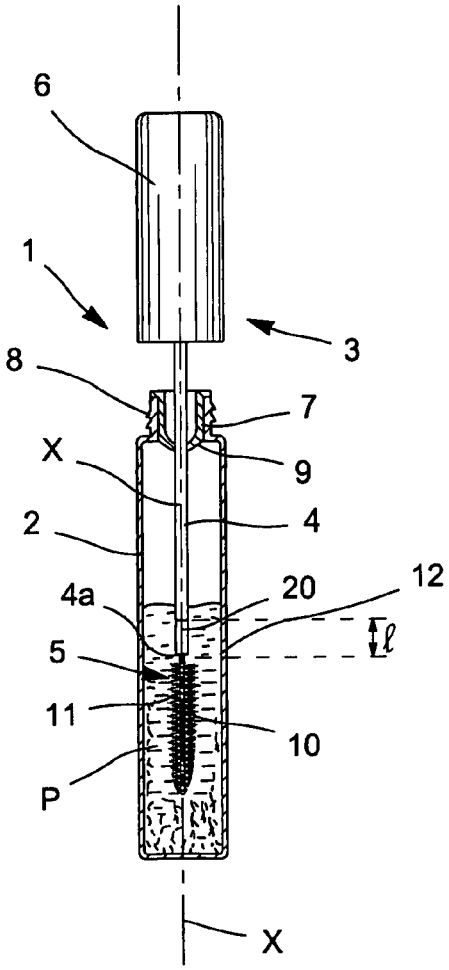
FIGS. 1 and 2 are diagrammatic views in elevation, and partially in axial section, showing an embodiment of a packaging and applicator device of the invention.
Figure 2:
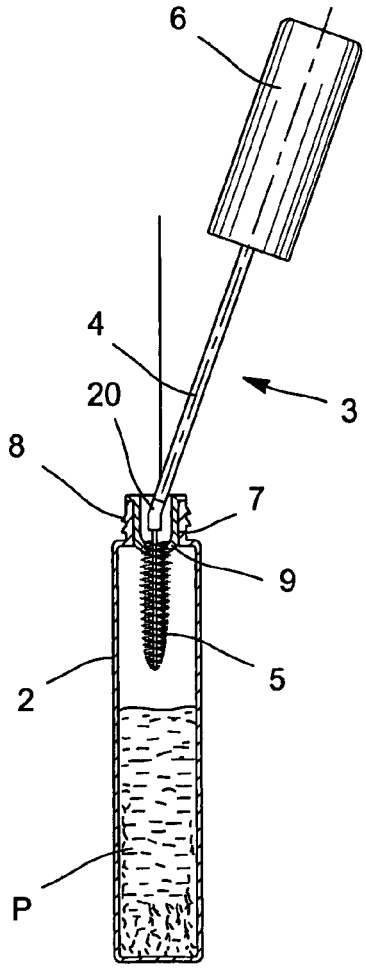
Figure 3:
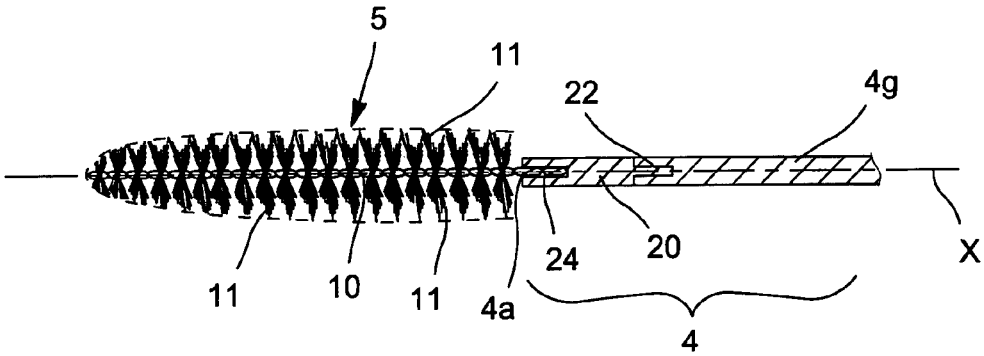
FIG. 3 is a diagrammatic and fragmentary axial section view of the applicator of the device in FIGS. 1 and 2.

FIGS. 1 to 3 show a packaging and applicator device 1 comprising: a receptacle 2 containing a composition P for application to the eyelashes or the eyebrows, e.g. mascara; and an applicator 3 comprising: a stem 4 that is provided at its distal end 4*a* with an applicator element 5 and that is connected at its proximal end to a handle 6 that also constitutes the closure cap for closing the receptacle 2. The receptacle is fitted with a wiper member 7, e.g. constituted by a part made of elastomer that is inserted into the neck 8 of the receptacle. The wiper member 7 can optionally be conventional, indeed it can be adjustable.

In manner known per se, when screwed tight, the handle 6 is arranged to close the receptacle 2 on the neck 8 in leaktight manner.

In the embodiment shown, the wiper member 7 defines a wiper orifice 9 of circular section, having a diameter that corresponds substantially to the diameter of the stem 4, said stem being of circular cross-section in the embodiment shown, at least over all of its portion engaged in the receptacle.

In the embodiment under consideration, the stem 4 presents a rectilinear longitudinal axis X that coincides substantially with the axis of the neck 8 of the receptacle 2 when the applicator 3 is in place on said receptacle.

The stem 4 includes both a rigid portion 4*g* and a flexible portion 20 that, in the embodiment described in FIGS. 1 to 3, extends from the distal end 4*a* of the stem 4.

In the embodiment shown in FIGS. 1 to 3, the flexible portion 20 is of circular cross-section, of diameter equal to the diameter of the remainder of the stem 4.

The flexible portion 20 is made of a material that is more flexible than the material of which the rigid portion 4*g* is made, e.g. a material from the following list: elastomer, thermoplastic, or thermoplastic elastomer material; LDPE; PVC; Hytrel®; EPDM; EVA; SIS; SEBS; latex; silicone; nitrile rubber; butyl; polyurethane; and polyether block amide.

By way of example, the rigid portion 4*g* is made of polyolefin.

By way of example, the rigid portion is made of POM, with an outside diameter of 4 mm and a length lying in the range 25 mm to 50 mm.

The flexible portion 20 makes it possible to impart flexibility to the stem 4, which is particularly useful while the applicator element 5 is being removed from the receptacle 2, as shown in FIG. 2.

In this figure, it can be seen that while the applicator element 5 is being removed from the receptacle 2, even if the user pulls on the applicator element 5 obliquely relative to the longitudinal axis of the receptacle 2, the applicator element 5 can, by means of the flexibility of the flexible portion 20, preserve an orientation that coincides substantially with the longitudinal axis of the receptacle 2 while passing through the wiper member 7.

In this way, the quality of the wiping of the applicator element 5 is preserved with regard to its evenness, and application can be performed under good conditions.

In addition, during application, the contact between the applicator element 5 and the eyelashes or the eyebrows can be lighter and the elasticity of the flexible portion can turn out to be advantageous for applying the composition, extending and separating the eyelashes or the eyebrow hairs, as explained above.

In the embodiment under consideration, the applicator element is a brush including a core 10 formed by two twisted metal strands, the core 10 having a proximal portion that is fastened in a housing of the stem 4, e.g. being force-fitted in the housing, as shown in FIG. 3.

The core 10 carries bristles 11 that are held by being clamped between the turns of the core 10 and that extend substantially radially from the core.

The flexible portion 20 can be fastened onto the rigid portion 4*g* in various ways, e.g. being force-fitted in a housing 22 of the rigid portion 4*g* of the stem 4, as shown in FIG. 3.

In addition, the flexible portion 20 includes a housing 24 for receiving a fastener portion of the applicator element 5, and, in particular in FIG. 3, an end of the core 10.

It can be seen in FIG. 3 that the housings 22 and 24 are the same size and the same shape, thereby making it possible to eliminate the flexible portion 20 and to insert the core 10 into the housing 22 of the stem 4 when the flexible portion 20 is not necessary, thereby making it possible to make economies of scale.

Naturally, various modifications can be applied to the applicator, and in particular to the applicator element and to the flexible portion, without going beyond the ambit of the present invention.

The flexible portion 20 can be fastened onto the remainder of the stem in various ways.

Figure 4:
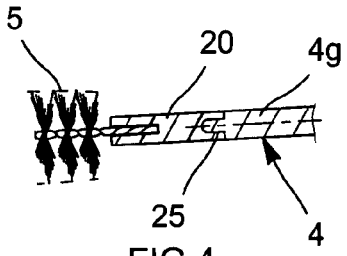

By way of example, the flexible portion can include a housing 25 for receiving a male fastener portion of the rigid portion 4*g*, as shown in FIG. 4.

Figure 5:
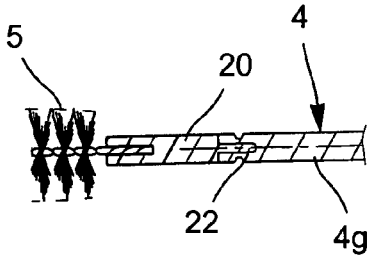

The flexible portion 20 can also be overmolded onto the rigid portion 4*g* or vice versa, or it can be held by being crimped in the housing 22 of the stem 4, as shown in FIG. 5.

Figure 6:
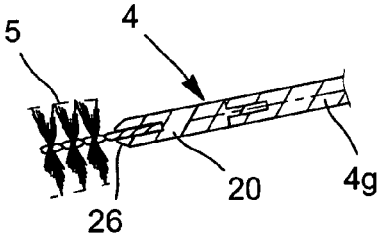

In addition, the shape of the flexible portion 20 can be other than cylindrical, as shown in FIG. 6.

By way of example, the flexible portion 20 can include a beveled end, as shown in FIG. 6, thereby making it easier to put the applicator 3 back into the receptacle 2.

Figure 7:
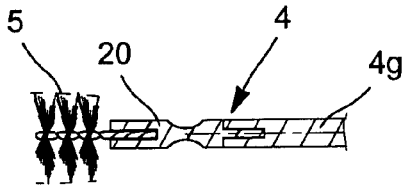
Figure 8:
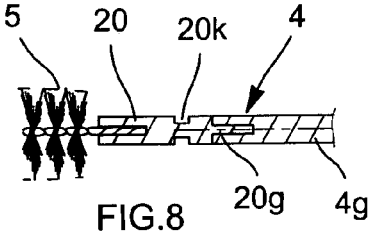

The flexible portion 20 can also include a thinned portion, e.g. an hourglass shape, as shown in FIG. 7, or it can include an annular groove 20*k* that is crenellated, as shown in FIG. 8.

The embodiment of FIG. 8 is particularly advantageous, because it allows to make the applicator member with a material which is not too soft while having a good angular course for the applicator member. The flexible portion has two preferential deformation zones, the first one at the level of the groove 20K and the second one at the level of the base $\mathbf{20}_g$ of the end piece inserted into the rigid portion. In this example, the visible surface of the visible portion adjacent to the rigid portion is inscribed in the continuity of the rigid portion, having a same diameter.

Figure 9:
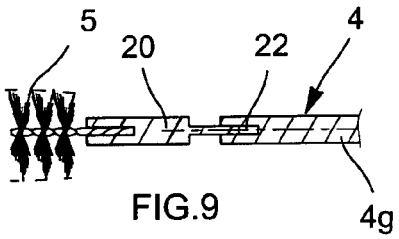

The flexible portion 20 can also be inserted only partially into the housing 22, as shown in FIG. 9, and, where appropriate, an annular groove can be formed in front of the end of the rigid portion 4*g* of the stem, the width of the groove depending on the degree to which the fastener portion of the flexible portion is pushed into the rigid portion of the stem.

The flexibility of the flexible portion can result solely from the choice of material from which it is made, or else it can result both from the choice of material and from its shape.

A thinned shape, as shown in FIGS. 7 to 9 can impart more flexibility.

Figure 10C:
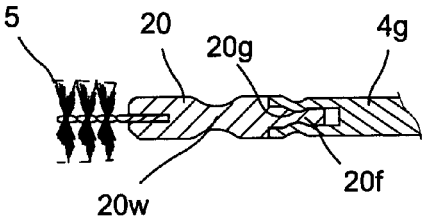
FIGS. 4 to 10 and 10A to 10E are views similar to FIG. 3 showing variant embodiments.
Figure 10D:
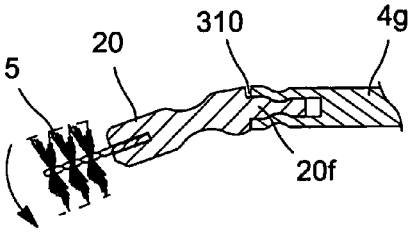
Figure 10:
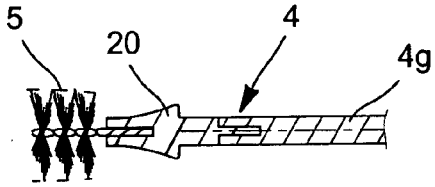

It would not be beyond the ambit of the present invention for the flexible portion 20 to present a greatest transverse dimension that is greater than a greatest transverse dimension of the remainder of the stem 4, as shown in FIG. 10.

Figure 10A:
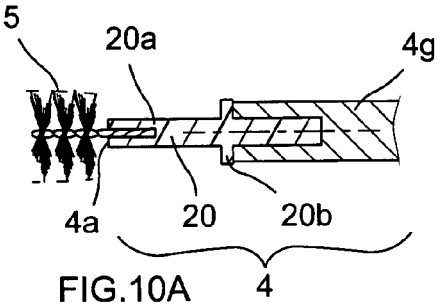

FIG. 10A shows a variant in which the flexible portion 20 includes a visible portion 20A that presents a smallest transverse dimension that is smaller than the smallest transverse dimension of the adjacent portion of the rigid portion 4*g*.

Where appropriate, the flexible portion can be made with a collar 20*b* that comes into abutment against the adjacent axial end of the rigid portion 4*g*.

Figure 10B:
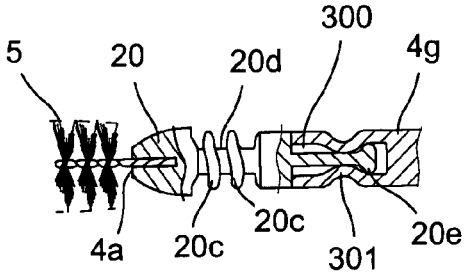

FIG. 10B shows the possibility of making the flexible portion 20 with a profile that varies between the portion of the flexible portion 20 that is for fastening the applicator element 5, and the portion of the flexible portion that is for fastening in the rigid portion 4*g*. In the embodiment shown and by way of example, the flexible portion includes a plurality of annular ribs 20*c* that are separated by annular grooves 20*d* that define zones of smaller diameter, thereby increasing the flexibility of the flexible portion 20. In this figure, it can also be seen that the end of the portion of the flexible portion 20 for fastening on the rigid portion 4*g* can include an enlarged head 20*e* that is held in a housing 300 of the rigid portion 4*g* by crimping the rigid portion 4*g* in such a manner as to form an inwardly-directed indentation 301.

FIG. 10C shows the possibility of the flexible portion presenting a portion 20*f* for fastening on the adjacent rigid portion 4*g*, a narrowing 20*g* being suitable for receiving an indentation resulting from crimping the rigid portion 4*g*.

In general manner and as shown, the flexible portion can be made with a narrowing 20*w* that is situated axially between the portion of the flexible portion for fastening the applicator element on the flexible portion and the portion of the flexible portion for fastening on the remainder of the stem.

FIG. 10D shows the FIG. 10C stem while the flexible portion 20 is being flexed. It can be seen in this figure that in addition to the flexible portion 20 deforming at its annular narrowing, the portion for fastening the rigid portion of the stem can also stretch, a gap 310 possibly appearing externally between the flexible portion and the end of the rigid portion 4*g*.

Figure 10E:
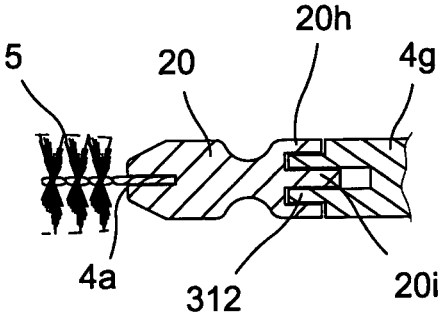

FIG. 10E shows the possibility of making the flexible portion 20 with a central portion 20*i* for engaging in a corresponding housing of the rigid portion 4*g*, and an outer tubular skirt 20*h* for coming to cover a tubular skirt 312 that is formed around the housing receiving the central portion 20*i*. This makes it possible to have a continuous outside diameter between the rigid portion 4*g* and the flexible portion 20 where said flexible portion is connected to the rigid portion 4*g*.

The outside of the cross-section of the flexible portion can also be other than circular, in particular at at least one point along its length.

Figure 11:
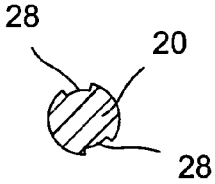
FIG. 11 is a cross-section of the flexible portion of a variant embodiment.

By way of example and as shown in FIG. 11, the flexible portion can include one or more grooves 28 that extend axially, thereby encouraging pressure to balance between the inside and the outside of the receptacle 2 while the applicator 3 is being inserted into or removed from the receptacle 2.

Still in a variant, the shape of the cross-section of the flexible portion can be other than circular, e.g. selected from the following list: polygonal; square; rectangular; triangular; non-circular; oblong; oval; elliptical; kidney-shaped; star-shaped; or with one or more grooves. In addition, the shape of the cross-section of the remainder of the stem can be selected from the same list.

The cross-sections of the flexible portion 20 and of the remainder of the stem can be identical or different, without going beyond the ambit of the present invention.

In the embodiments described above, the flexible portion 20 defines the distal end 4*a* of the stem 4, but it would not be beyond the ambit of the present invention if this were otherwise.

Figure 12:
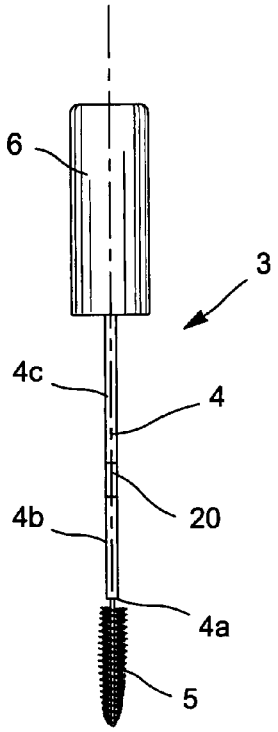
FIG. 12 is an elevation view of a variant of an applicator.

By way of example, FIG. 12 shows an embodiment in which the flexible portion 20 is disposed between a rigid distal portion 4*b* of the stem, and a rigid proximal portion 4*c* of the stem.

In addition, in all of the embodiments described above, the stem is shown with a longitudinal axis X that is rectilinear, but it would not be beyond the ambit of the present invention if this were otherwise.

Figure 13:
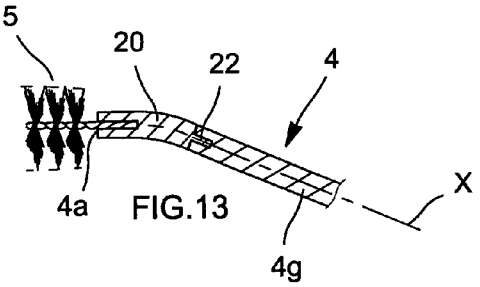
FIG. 13 is a view similar to FIG. 3 showing a variant embodiment.

By way of example, FIG. 13 shows an embodiment in which the longitudinal axis X of the stem 4 is curved.

The curve of the longitudinal axis X of the stem 4 can be as a result of the curved shape of the flexible portion 20, or even as a result of the curved shape of a rigid portion of the stem 4.

The curved shape can be as a result of inserting a curved fastener portion of the flexible portion 20 more or less completely into the housing 22 of the rigid portion of the stem 4.

Figure 14:
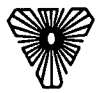
FIGS. 14 to 23 show examples of cross-sections of the envelope surfaces of brushes, amongst others.

In addition, the applicator element can have an envelope surface of circular cross-section, or, as shown in FIGS. 14 to 23, it could present another shape in cross-section at least one point along its length, e.g. a triangular shape as shown in FIG. 14.

Figure 15:
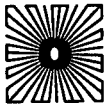
Figure 16:
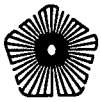
Figure 17:
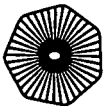

The applicator element can also be given various other cross-sections, e.g. square, as shown in FIG. 15, or pentagonal or hexagonal, as shown in FIGS. 16 and 17 respectively.

Figure 18:
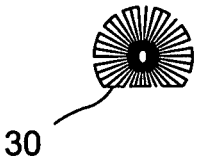
Figure 19:
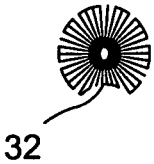
Figure 20:
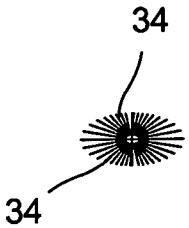

The applicator element can include at least one plane or concave face. By way of example, the applicator element can include an envelope surface of circular cross-section with at least one flat 30, as shown in FIG. 18, with at least one concave side 32, as shown in FIG. 19, or with at least one convex side 34, as shown in FIG. 20. In FIG. 20, it can be seen that the applicator element can present an envelope surface of cross-section that is oblong, in particular lens-shaped.

Figure 21:
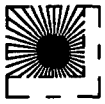
Figure 22:
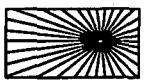
Figure 23:
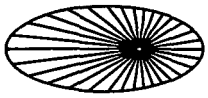

In the cross-section examples shown in FIGS. 14 to 20, the cross-section is shown centered relative to the core. In a variant, the core can also be off-center relative to the cross-section of the envelope surface at at least one point along the applicator element, as shown in FIGS. 21 to 23. In FIG. 21 the cross-section is square, in FIG. 22 it is rectangular, and in FIG. 23 it is oblong. Whatever its shape, the cross-section can be centered or off-center relative to the core.

The envelope surface E can be of constant circular cross-section over the major portion of the length of the applicator element, or even over its entire length.

In a variant, the envelope surface can present at least one portion having a cross-section that varies, e.g. in geometrically similar manner, e.g. decreasing towards the free end of the applicator element.

Figure 24:
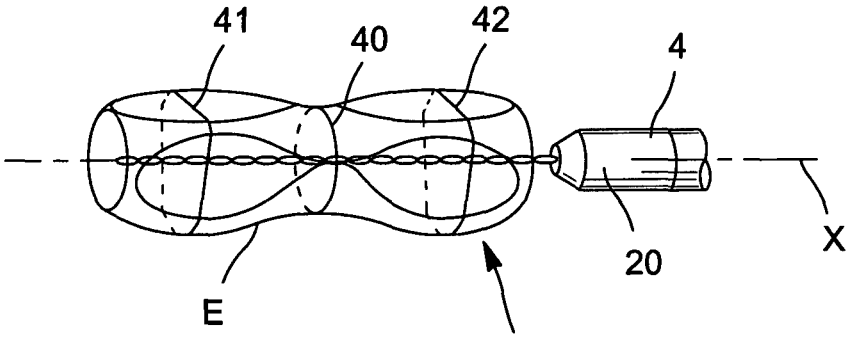
FIGS. 24 to 32 are fragmentary views of variant embodiments of brushes.

Still in a variant, the cross-section of the envelope surface E of the applicator element can pass through at least one extremum between its two axial ends, e.g. a maximum or a minimum, or even both, as can be seen in FIG. 24. In this figure, the cross-section passes through a minimum 40 and two maximums 41, 42.

Figure 25:
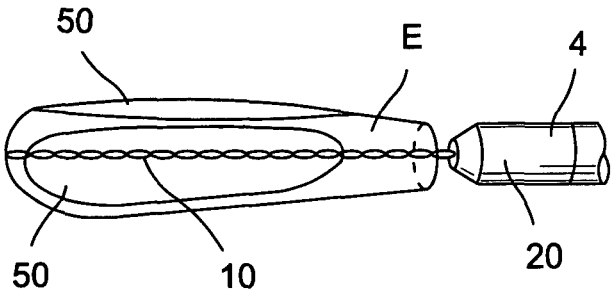

In another variant, the envelope surface of the applicator element is not symmetrical about a mid-plane that is perpendicular to the core, e.g. as shown in FIG. 25. In this embodiment, the applicator element is made from a blank on which facets 50 have been cut.

Figure 26:
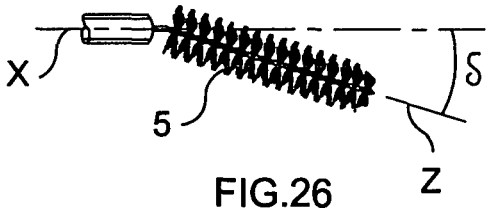

The longitudinal axis Z of the core 10 of the applicator element 5 can coincide with the longitudinal axis X of the stem 4, or, in a variant, it can be distinct. By way of example, FIG. 26 shows an embodiment in which the core of the applicator element extends along an axis Z forming an angle δ with the axis X. The angle can lie in the range 1° to 15°, for example.

In addition, in the embodiments described above, the core of the applicator element 5 is rectilinear, but it would not be beyond the ambit of the present invention if this were otherwise.

Figure 27:
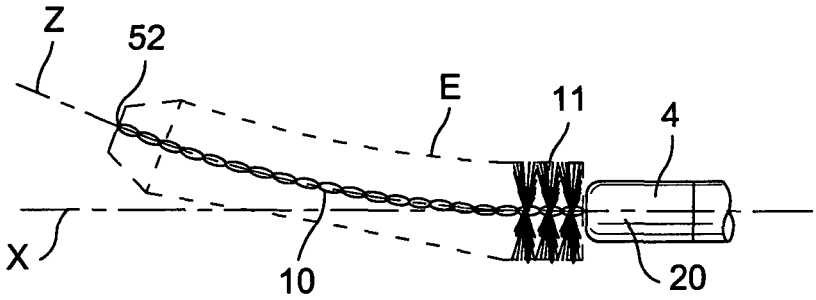
Figure 28:
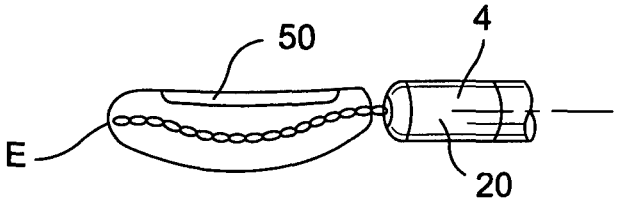
Figure 29:
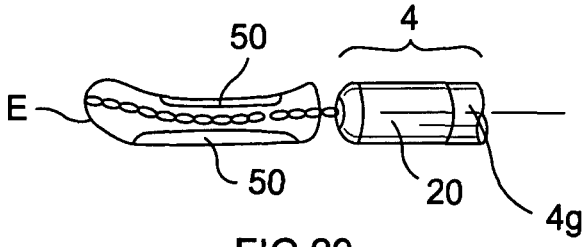

By way of example, FIGS. 27 to 29 show three embodiments in which the core of the applicator element is curved. In the embodiment shown in FIG. 27, the applicator element presents a plane face and a concave face. In the embodiment in FIG. 28, the applicator element presents a plane face 50 and a convex face, and in the embodiment in FIG. 29, the applicator element presents two plane faces 50.

Figure 30:
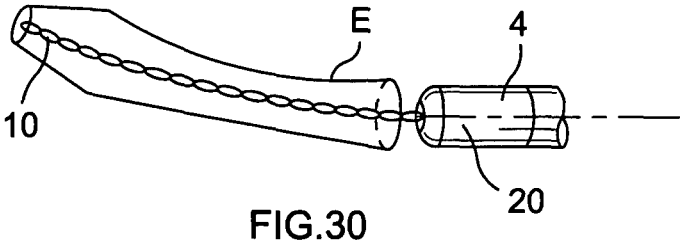

In the embodiment shown in FIG. 30, the applicator element includes a core 10 that is curved over at least a fraction of its length, and an envelope surface E that is not symmetrical about a mid-plane that is perpendicular to the core. In addition, the angle between the axis X and the axis of the core is, at any point along the core, less than 90°. The free end of the applicator element is not in alignment with the axis X.

In the embodiment shown in FIG. 27, the applicator element 5 includes a free end 52 that constitutes the point of the applicator element that is the furthest away from the longitudinal axis X.

In this embodiment, the core of the applicator element extends along a longitudinal axis Z on the same side of a plane containing the axis X.

Figure 31:
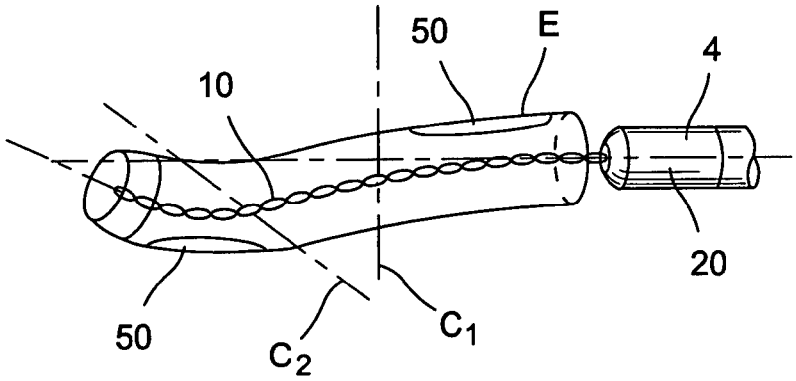

In another variant shown in FIG. 31, the applicator element is curved about at least two axes $C_1$, $C_2$ that are not parallel to each other. The axes $C_1$ and $C_2$ extend in directions that can be perpendicular, for example.

Figure 32:
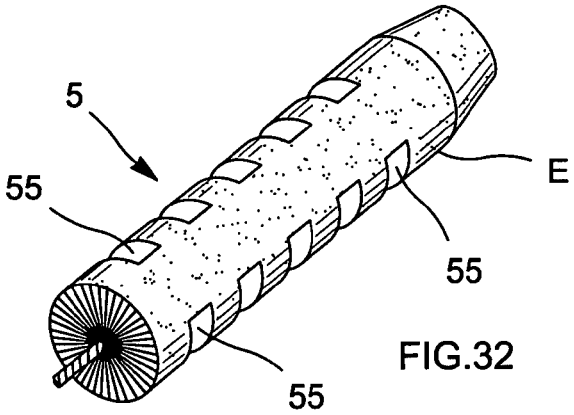

In the variant shown in FIG. 32, the applicator element is made from a blank in which notches 55 have been cut.

In cross-section, the notches present an outwardly-convex shape, but it would not be beyond the ambit of the present invention for the cross-section of the notches to present an outwardly-concave shape.

In the embodiments described above, the core is constituted by a twisted wire in which the bristles are held.

The strands of the core can be given a left-hand twist or a right-hand twist.

Figure 33:
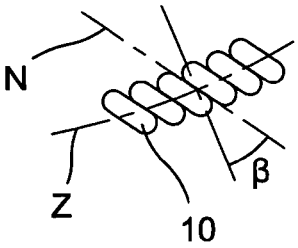
FIGS. 33 and 34 show twisted cores respectively having left-hand and right-hand twist.
Figure 34:
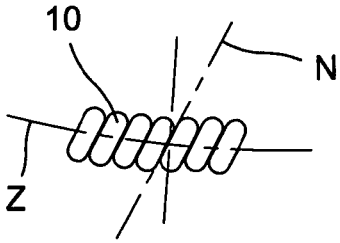

It is particularly advantageous to use a brush having a left-hand twist. FIG. 33 shows a brush with a core having a left-hand twist, and FIG. 34 shows a brush with a core having a right-hand twist. The path of the sheets N defined by the ends of the bristles is shown diagrammatically by chain-dotted lines, the sheets forming an angle β with a plane that is perpendicular to the core. Reference can usefully be made to European patent EP 0 611 170.

Figure 35:
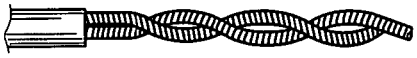
FIG. 35 diagrammatically shows a double core that is formed by twisting together two individual twisted cores.

The core can also be a double core, formed by two individual cores that are twisted together, as shown in FIG. 35. Each individual core can comprise two strands that are twisted together, trapping bristles. Each of the two individual cores can be constituted by a branch of a single twisted core that is folded in a U-shape, the two branches being twisted together.

Any kind of bristle can be used in an applicator element made in accordance with the invention, and in particular bristles presenting a cross-section that is circular or other than circular. In particular, it is possible to use a mixture of bristles of different kinds, or a mixture of bristles of different lengths, optionally of the same kind.

By way of example, the applicator elements shown are made with bristles of circular section, of diameter lying in the range 65 μm to 400 μm.

Figure 36:
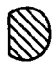
FIGS. 36 to 53 show various examples of bristle cross-sections.
Figure 37:
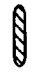
Figure 38:
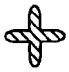
Figure 39:
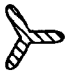
Figure 40:
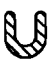
Figure 41:
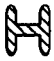
Figure 42:
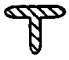
Figure 43:
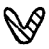
Figure 44:
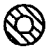
Figure 45:
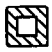
Figure 46:
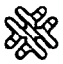
Figure 47:
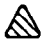
Figure 48:
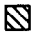
Figure 49:
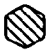
Figure 50:
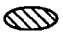
Figure 51:
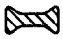
Figure 52:
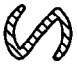
Figure 53:
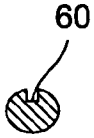

It is possible to use bristles presenting, in cross-section, one of the shapes shown diagrammatically in FIGS. 36 to 53, e.g. a circular shape with a flat as shown in FIG. 36, a flat shape as shown in FIG. 37, a star shape, e.g. a cross shape, as shown in FIG. 38 or having three branches as shown in FIG. 39, U-shaped as shown in FIG. 40, H-shaped as shown in FIG. 41, T-shaped as shown in FIG. 42, V-shaped as shown in FIG. 43, a hollow shape, e.g. circular as shown in FIG. 44 or square as shown in FIG. 45, forming ramifications, e.g. snowflake-shaped as shown in FIG. 46, of prismatic section, e.g. triangular as shown in FIG. 47, square as shown in FIG. 48, or hexagonal as shown in FIG. 49, or even oblong-shaped, in particular lens-shaped as shown in FIG. 50, or hourglass-shaped as shown in FIG. 51. It is possible to use bristles having portions that are hinged relative to one another, as shown in FIG. 52. It is also possible to use bristles that present at least one capillary channel 60, as shown in FIG. 53.

Figure 54:
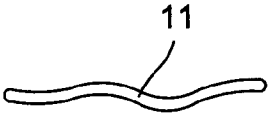
FIG. 54 shows a side view of an undulating bristle.

Before being put into place between the strands of the core, the bristles 11 that are held between the twisted strands of the core can present an optionally rectilinear shape, e.g. an undulating shape, as shown in FIG. 54.

Figure 55:
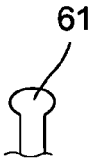
FIGS. 55 to 58 are fragmentary and diagrammatic views of examples of bristles.
Figure 56:
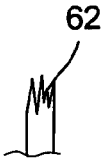

The bristles can be subjected to a treatment that seeks to form, at their ends, beads 61, as shown in FIG. 55, or spikes 62, as shown in FIG. 56.

Figure 57:
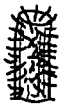
Figure 58:
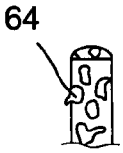

It is possible to use flocked bristles, as shown in FIG. 57, or even bristles that are made by extruding a plastics material containing a filler of particles 64, e.g. particles of a moisture-absorbing material, so as to impart a micro-relief to the surface of the bristles, as shown in FIG. 58, or so as to give them magnetic or other properties.

The bristles can also be made with a material presenting properties that favors sliding.

The bristles can be natural or synthetic, and they can, for example, be made of a material selected from: polyethylene (PE); polyamide (PA), in particular PA6, PA6/6, PA6/10, or PA6/12; HYTREL®; PEBAX®; silicone; and polyurethane (PU); this list not being limiting.

Figure 59:
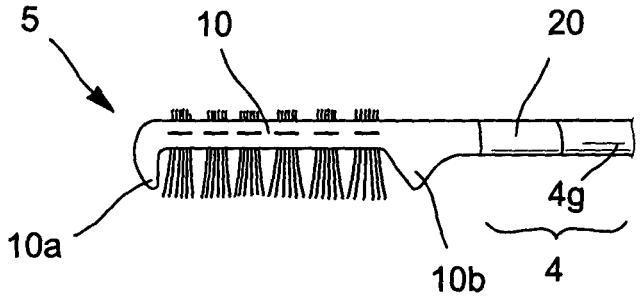

The core of the applicator element 5 can also be other than twisted, e.g. including through holes in each of which a bundle of bristles is held, as shown in FIG. 59.

In this embodiment, the core 10 further includes a front portion 10*a* and a rear portion 10*b* that are profiled in such a manner as to make it easier for the applicator element 5 to be inserted into the receptacle and to pass through the wiper member 9.

Figure 60:
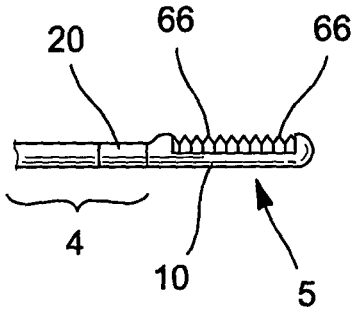
FIGS. 59 to 61 show variant embodiments of the applicator element.

In another variant shown in FIG. 60, the applicator element 5 is made by molding a plastics material, in particular by injection molding, and it comprises a core 10 carrying teeth 66 that are made integrally with the core 10 and that extend transversally to the axis X of the stem 4.

Naturally, the invention is not limited to the embodiments described above.

By way of example, the composition could be applied by means of a vibrating applicator.

Figure 1A:
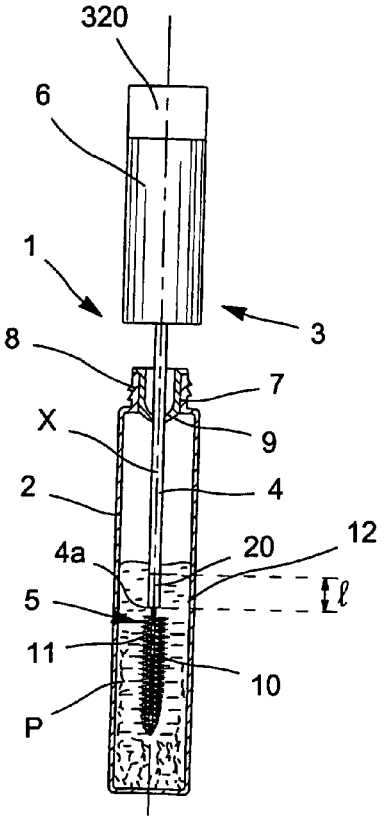
FIG. 1A is a view similar to FIG. 1 showing a variant embodiment.

By way of example and as shown in FIG. 1A, the applicator includes a vibration generator 320 (also known as a vibration source) that is secured to the handle 6, for example, and that is suitable for being fastened on said handle in optionally removable manner.

Such a vibration generator is described in French patent application FR 2 882 506.

The vibration makes it possible to obtain better separation of the eyelashes, and when using a composition containing fibers, better orientation of said fibers and/or greater ease in taking up the composition. While taking up composition, the applicator element can be subjected to the vibration of the vibration source, thereby making it possible, where appropriate, for the composition to be loaded in more uniform manner on the applicator element.

The flexible portion 20 can amplify the vibration transmitted to the applicator element 5.

In particular, the flexible portion 20 can be made in such a manner as to resonate with the vibration frequencies from the vibration source 320, thereby making it possible to amplify the amplitude of the vibration.

Figure 61:
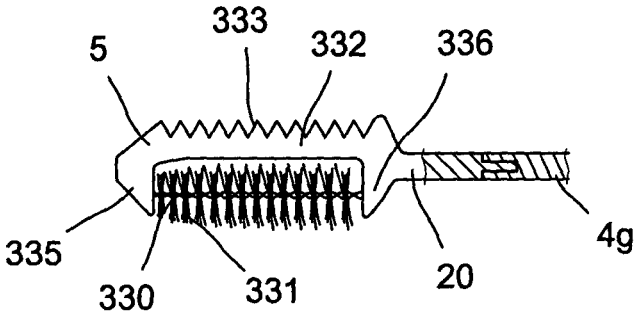

FIG. 61 shows an applicator element 5 that presents the distinctive feature of comprising a brush 330 having a twisted metal core and bristles 331 held by the core, the brush being carried by a support 332 that is made integrally with the flexible portion 20. In the embodiment under consideration, the support 332 presents teeth 333 on the side remote from the brush 330. The ends of the core 330 of the brush are fastened in walls 335 and 336 that are made integrally with the remainder of the support and that are profiled so as to make it easier to pass through the wiper member. It would not be beyond the ambit of the present invention for the support to be of a different shape, in particular making it without the teeth 333 or without the brush.

When the receptacle includes a wiper member through which the applicator element is removed, the applicator element can optionally be subjected to vibration while passing through the wiper member, thereby making it possible to wipe the applicator element in a way that is different to the way it is wiped when it is not vibrating. By way of example, the user can thus choose between at least two degrees of wiping the applicator element, depending on whether or not the applicator element is vibrating while passing through the wiper member.

The composition can also be applied by means of a device that is used to apply the composition, the device including: removable fastener means for fastening to at least one finger, a hand, or a wrist, or being hand held; and a vibration source that makes it possible to produce vibration.

In another of its aspects, the invention also provides an applicator comprising:

an applicator element for applying a composition to the eyelashes or the eyebrows;

a stem at one end of which the applicator element is fastened; and a handle that is fastened to the opposite end of the stem, the stem being made with two segments made of materials that present different hardnesses, the segment made of the softer material preferably being adjacent to the applicator element. The applicator element can be a brush having a twisted metal core.

In another of its aspects, the invention also provides a vibration source and an applicator as defined above.

The term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a composition to keratinous fibers, in particular the eyelashes or the eyebrows, the applicator comprising:

a stem having a longitudinal axis and including (1) at least one elastically-deformable flexible portion, made of a material selected from the group consisting of: elastomer, LDPE, PVC, PU, thermoplastic elastomer polyester, EPDM, PDM, EVA, SIS, SEBS, SBS, latex, silicone, nitrile rubber, butyl, polyurethane, polyether block amide, and polyester, that is suitable for flexing during application and/or wiping and (2) a rigid portion including a housing for fastening to the flexible portion; and an applicator element that is fastened to the stem and that includes a twisted wire core and bristles that extend transversally to the longitudinal axis of the stem, the flexible portion of the stem being adjacent to a first end of the stem, the applicator element being fastened to the flexible portion, an end of the twisted wire core of the applicator element being inserted into a housing of the flexible portion, the flexible portion of the stem including a narrowing in the form of an annular groove located between the end of the twisted wire core inserted into the housing of the flexible portion and an end of the rigid portion of the stem adjacent to the flexible portion.

2. An applicator according to claim 1, the stem presenting a top half that is substantially non-flexible, the flexible portion being situated in a bottom half of the stem.

3. An applicator according to claim 1, the stem including a single flexible portion, and a remainder of the stem being rigid.

4. An applicator according to claim 1, in which the flexible portion is fastened to a remainder of the stem by snap-fastening, by screw-fastening, by adhesive, by force-fitting, or by crimping.

5. An applicator according to claim 1, in which the rigid portion of the stem has at least one housing for receiving at least one fastener portion for fastening the flexible portion on an adjacent portion of the stem.

6. An applicator according to claim 1, the flexible portion comprising an endpiece inserted in a housing of the stem, the groove and a base of the endpiece constituting two zones of preferred deformation for the flexible portion, when the applicator member is inclined relative to a rest position of the applicator member.

7. An applicator according to claim 1, the flexible portion having a diameter equal to a diameter of the adjacent rigid portion, at least in a zone of the flexible portion located in the continuity of the rigid portion.

8. An applicator according to claim 1, in which the stem includes one or more rigid portions made of at least one thermoplastic material.

9. An applicator according to claim 8, the thermoplastic material(s) being selected from the group consisting of: HDPE, LDPE, linear PE, PP, PT, POM, PA, PET, and PBT.

10. An applicator according to claim 1, the flexible portion being made of a thermoplastic elastomer.

11. An applicator according to claim 1, in which the core is not rotatable relative to the stem around the longitudinal axis of the stem.

12. An applicator according to claim 1, the flexible portion being at least partially flocked.

13. An applicator according to claim 1, the core comprising two twisted strands of a wire.

14. An applicator according to claim 1, in which the stem is connected to a handle that is arranged in such a manner as to close, in leaktight manner, a receptacle containing the composition for application.

15. An applicator according to claim 1, the stem including a rigid portion of thermoplastic material, of diameter that is greater than or equal to 2.5 mm.

16. An applicator according to claim 1, the flexible portion being configured to resonate with vibration frequencies from a vibration generator that is integrated in the applicator or that is brought into contact therewith.

17. A packaging and applicator device for applying a cosmetic composition to the eyelashes or the eyebrows, the device comprising an applicator according to claim 1, and a receptacle containing the composition for application.

18. A cosmetic treatment using an applicator according to claim 1, in which a composition is applied on the applicator element by modifying an angle formed between the applicator element and the stem by deforming the flexible portion.

19. An applicator for applying a composition to keratinous fibers, in particular the eyelashes or the eyebrows, the applicator comprising:

a stem having a longitudinal axis and including (1) at least one elastically-deformable flexible portion, made of a material selected from the group consisting of: elastomer, LDPE, PVC, PU, thermoplastic elastomer polyester, EPDM, PDM, EVA, SIS, SEBS, SBS, latex, silicone, nitrile rubber, butyl, polyurethane, polyether block amide, and polyester, that is suitable for flexing during application and/or wiping and (2) a rigid portion; and an applicator element that is fastened to the stem and that includes a twisted wire core and bristles that extend transversally to the longitudinal axis of the stem, the flexible portion of the stem being adjacent to a first end of the stem, the applicator element being fastened to the flexible portion, the flexible portion of the stem including a housing, and an end of the twisted wire core of the applicator element being inserted into the housing.

* * * * *